US008092750B2

(12) United States Patent
Liu et al.

(10) Patent No.: US 8,092,750 B2
(45) Date of Patent: Jan. 10, 2012

(54) PLASMA SYSTEM

(75) Inventors: Chi-Hung Liu, Taichung County (TW); Chen-Der Tsai, Hsinchu County (TW); Chun-Hsien Su, Hsinchu (TW); Wen-Tung Hsu, Hsinchu County (TW); Jen-Hui Tsai, Hsinchu (TW); Chun Huang, Taipei County (TW)

(73) Assignee: Industrial Technology Research Institute, Hsinchu (TW)

( * ) Notice: Subject to any disclaimer, the term of this patent is extended or adjusted under 35 U.S.C. 154(b) by 423 days.

(21) Appl. No.: 12/388,552

(22) Filed: Feb. 19, 2009

(65) Prior Publication Data

US 2010/0098600 A1 Apr. 22, 2010

(30) Foreign Application Priority Data

Oct. 20, 2008 (TW) ..... 97140202 A

(51) Int. Cl.
*H05H 1/24* (2006.01)

(52) U.S. Cl. ..... 422/186.04; 315/111.21; 315/111.31; 422/186.18; 118/723 R; 118/723 ER; 313/231.31

(58) Field of Classification Search ..... None
See application file for complete search history.

(56) References Cited

U.S. PATENT DOCUMENTS 6,262,386 B1 7/2001 Fornsel
6,677,550 B2 1/2004 Fornsel
6,707,051 B2 * 3/2004 Shun'ko ..... 250/492.1
2002/0008480 A1 * 1/2002 Yamazaki et al. ..... 315/111.21
2004/0085023 A1 * 5/2004 Chistyakov ..... 315/111.21
2005/0006220 A1 * 1/2005 Chistyakov ..... 204/164
2007/0246355 A1 * 10/2007 Toyoda et al. ..... 204/298.02

OTHER PUBLICATIONS

"Micro-Structured Electrode Arrays: Glow Discharges in Ar and N2 at Atmospheric Pressure Using a Variable Radio Frequency Generator" Christian Schrader et al., ScienceDirect, Vacuum 80 (2006) 1144-1148.

* cited by examiner

*Primary Examiner* — P. Kathryn Wright
(74) *Attorney, Agent, or Firm* — Thomas|Kayden

(57) ABSTRACT

A plasma system for generating a plasma is generated. The plasma system includes a tube, a positive electrode and a negative electrode. The tube has a plasma jet opening, a first end surface and a second end surface. The plasma jet opening penetrates the wall of the tube. The plasma passes through the plasma jet opening and is emitted to the outside of the tube. The positive electrode has a side surface facing and adjacent to the tube. The negative electrode is separated from the positive electrode by a first predetermined distance. The negative electrode has a negative electrode side surface facing and adjacent to the tube. The first positive electrode and the first negative electrode are disposed between the first end surface and the second end surface, and a portion of the plasma jet opening is disposed between the positive electrode and the negative electrode.

22 Claims, 9 Drawing Sheets

200

PLASMA SYSTEM

This application claims the benefit of Taiwan application Ser. No. 97140202, filed Oct. 20, 2008, the subject matter of which is incorporated herein by reference.

BACKGROUND OF THE INVENTION

1. Field of the Invention

The invention relates in general to a plasma system, and more particularly to a plasma system capable of preventing the electrodes from being damaged.

2. Description of the Related Art

Along with the prosperity in the semiconductor industry, various manufacturing methods, processes and facilities are developed and used. Plasma can perform surface treatment such as surface cleaning, surface etching, trench etching, thin film deposition and hydrophilic treatment, and hydrophobic treatment on the surface of a substrate. Examples of plasma processing facility include plasma cleaning, plasma enhance chemical vapor deposition (PECVD), plasma enhance reactive ion etching (PERIE), micro wave plasma oxidation, micro wave plasma nitridation, ionized metal plasma (IMP) and sputter deposition.

Despite the plasma is electrically neutral, there are many particles with different potentials in the atmosphere of plasma. Examples of particles include atoms, free radicals, ion, molecules, molecule free radicals, polarized molecules, electrons and photons. The particles are generated inside the reaction chamber of plasma facility. There are positive and negative electrodes disposed inside the reaction chamber. When the gas between positive and negative electrodes is driven by the voltage between two electrodes, the gas is dissociated and plasma is generated.

However, the electrodes disposed inside the reaction chamber will be polluted or eroded by plasma particles and then become damaged. When the electrodes are damaged, plasma stability as well as the quality of plasma products will be affected. As plasma facility is a constant-pressure system, an expensive carrying platform is needed if the range of plasma treatment is to be expanded. Furthermore, the constant-pressure system normally requires a higher power for driving plasma, that is, the plasma is driven by either a large current or a large voltage. When the current or the voltage is too large, heat problem such as electrode deformation will occur.

SUMMARY OF THE INVENTION

The invention is directed to a plasma system, in which the positive and the negative electrodes are separated from the reaction chamber such that the plasma does not contact the electrodes. Thus, the electrode will not be polluted or damaged.

According to a first aspect of the present invention, a plasma system plasma system for generating a plasma is provided. The plasma system includes a first tube, a first positive electrode and a first negative electrode. The first tube has a first inlet, a first plasma jet opening, a first end surface and a second end surface. A plasma gas passes through the first inlet and enters the first tube. The first plasma jet opening penetrates the wall of the first tube. The plasma passes through the plasma jet opening and is emitted to the outside of the first tube. The first positive electrode has a first side surface and a first positive electrode surface. The first positive electrode side surface is connected to the first positive electrode surface. The first positive electrode side surface faces and is adjacent to the first tube. The first negative electrode has a first negative electrode side surface and a first negative electrode surface. The first negative electrode side surface is connected to the first negative electrode surface. The first negative electrode surface is separated from the first positive electrode surface by a first predetermined distance. The first negative electrode side surface faces and is adjacent to the first tube. The first positive electrode and the first negative electrode are disposed between the first end surface and the second end surface, and at least a portion of the first plasma jet opening is disposed between the first positive electrode and the first negative electrode.

The invention will become apparent from the following detailed description of the preferred but non-limiting embodiments. The following description is made with reference to the accompanying drawings.

DETAILED DESCRIPTION OF THE INVENTION

Figure 1:
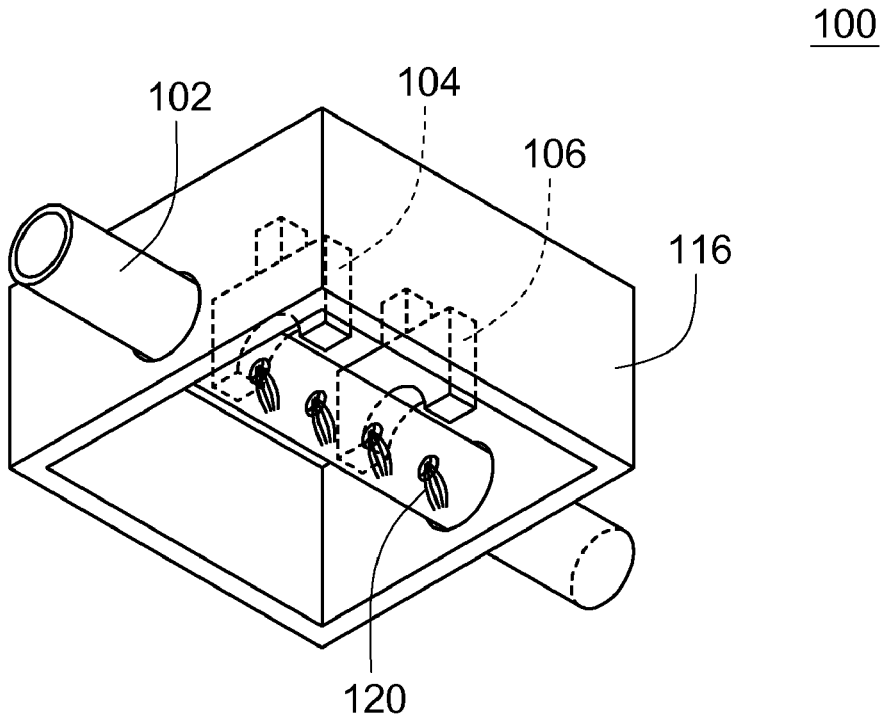
FIG. 1 shows a plasma system according to a first embodiment of the invention.

Referring to FIG. 1, a plasma system according to a first embodiment of the invention is shown. The plasma system 100 for generating a plasma 120. The plasma system 100 includes a first tube 102, a first positive electrode 104, a first negative electrode 106 and a casing 116.

Figure 2:
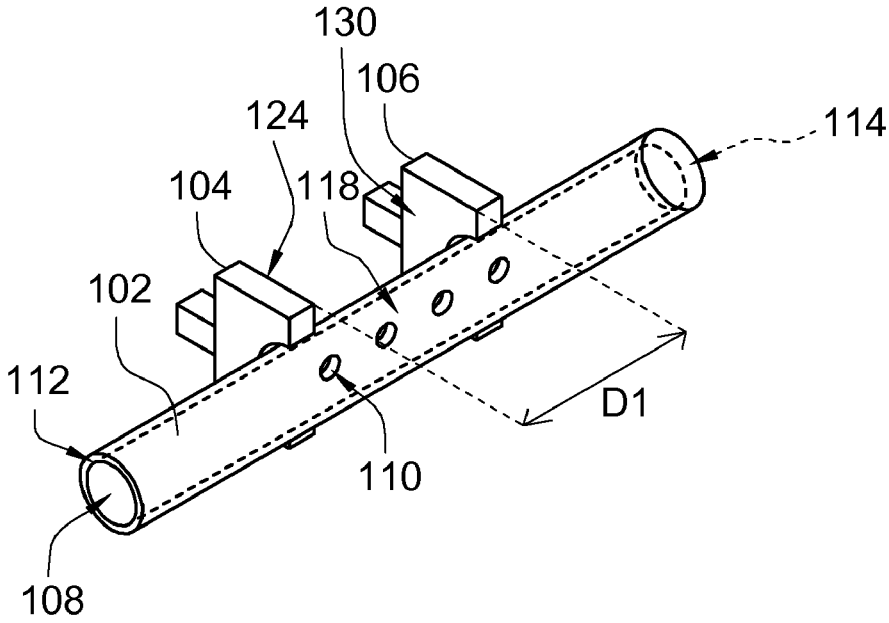
FIG. 2 shows a first tube, a first positive electrode and a first negative electrode of FIG. 1.

Referring to FIG. 2, a first tube, a first positive electrode and a first negative electrode of FIG. 1 are shown. The first tube 102 has a first inlet 108, a first plasma jet opening 110, a first end surface 112 and a second end surface 114. The first tube 102 is made from a dielectric material such as quartz. The first tube 102 can be a round tube or a squared tube. In the present embodiment of the invention, the first tube 102 is exemplified by a round tube.

A plasma gas (not illustrated) passes through the first inlet 108 and enters the first tube 102. Despite the first inlet 108 is disposed on the first end surface 112 in the present embodiment of the invention, the first inlet 108 can also be disposed on the second end surface 114 in other embodiments. Preferably, only one end surface has an inlet, and the other end surface is closed. For example, the second end surface 114 is closed to avoid impurities entering from the second end surface 114 and affecting the stability of the plasma. Or, in other embodiments, both the first end surface 112 and the second end surface 114 have an inlet. That is, the first end surface 112 has a first inlet 108 and the second end surface 114 has a second inlet (not illustrated). The second inlet disposed on the second end surface 114 increases the uniformity in the flow field of the plasma gas. Whether to have one or two inlet is determined according to actual needs, and the exemplification in the present embodiment of the invention is not for limiting the number of the inlet.

As indicated in FIG. 2, the first positive electrode 104 and the first negative electrode 106 are disposed between the first end surface 112 and the second end surface 114. A first negative electrode surface 130 of the first negative electrode 106 is separated from a first positive electrode surface 124 of the first positive electrode 104 by a first predetermined distance D1, which is equal to or larger than 6 mm. The value of the first predetermined distance D1 is not restricted by the exemplification in the present embodiment of the invention as long as any value capable of preventing arcing between the first negative electrode 106 and the first positive electrode 104 and enabling the plasma 120 to be normally generated. The first plasma jet opening 110 is disposed between the first positive electrode 104 and the first negative electrode 106 and penetrates the wall 118 of the first tube 102. The plasma 120 (illustrated in FIG. 1) passes through the first plasma jet opening 110 and is emitted to the outside of the first tube 102. In the present embodiment of the invention, the first plasma jet openings 110 are a circle, and the number of the first plasma jet openings 110 is four. The aperture of the first plasma jet openings 110 is about 0.5 mm, and the interval between the first plasma jet openings 110 is about 2 mm. Besides, the first plasma jet openings 110 do not face the first positive electrode 104 or the first negative electrode 106. In the present embodiment of the invention, the electrodes including the first positive electrode 104 and the first negative electrode 106 are disposed outside the first tube 102 and do not contact the plasma particles inside the first tube 102. Furthermore, when the plasma 120 is emitted from the first plasma jet openings 110, the plasma 120 does not contact the first positive electrode 104 or the first negative electrode 106. Thus, the electrodes are not damaged.

Figure 3:
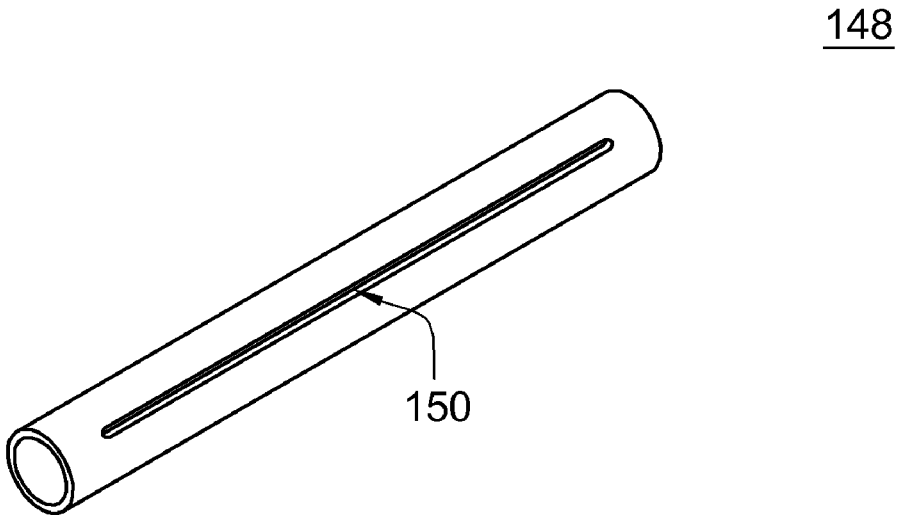
FIG. 3 shows another embodiment of the first tube of FIG. 2.

Despite there are four first plasma jet openings 110 in the present embodiment of the invention, the number of the first plasma jet openings 110 can be less than or more than four in other embodiments. The first plasma jet openings 110 can be partially distributed between the first positive electrode 104 and the first negative electrode 106 or fully and uniformly distributed between the first positive electrode 104 and the first negative electrode 106. Referring to FIG. 3, another embodiment of the first tube of FIG. 2 is shown. In another embodiment, the first tube 148 has a first plasma jet opening 150 and is bar-shaped. Preferably, the length of the first plasma jet opening 150 is larger than a first predetermined distance D1 (illustrated in FIG. 2) so as to expand the emission coverage of the plasma 120 (illustrated in FIG. 1).

The size, the number, the position and the interval of the first plasma jet openings 110 are not restricted by the exemplification in the present embodiment of the invention as long as any first plasma jet openings 110 capable of uniformly generating the plasma 120.

Figure 4:
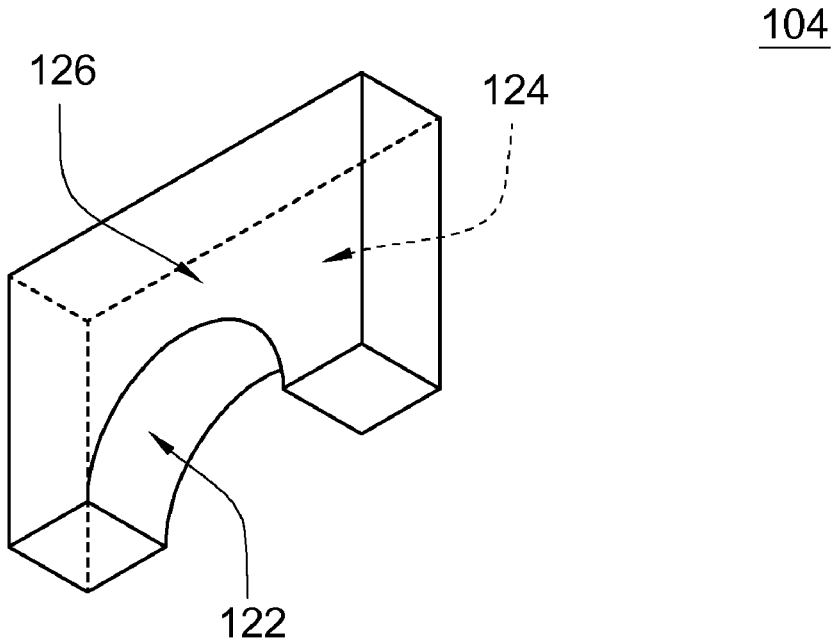
FIG. 4 shows a first positive electrode of FIG. 1.

Referring to FIG. 4, a first positive electrode of FIG. 1 is shown. The first positive electrode 104 has a first positive electrode side surface 122 and a second positive electrode surface 126 opposite to the first positive electrode surface 124. The first positive electrode side surface 122 connected to the first positive electrode surface 124 and the second positive electrode surface 126 is substantially perpendicular to the first positive electrode surface 124. The first positive electrode side surface 122 faces and is adjacent to the first tube 102. As long as the first positive electrode side surface 122 neighbors the first tube 102, the first positive electrode side surface 122 may or may not contact the first tube 102. In the present embodiment of the invention, the first positive electrode side surface 122 does not contact the first tube 102. Besides, the thickness of the first positive electrode 104 is about 5 mm.

Moreover, the cross-sectional shape of the first positive electrode side surface 122 is similar to that of the corresponding first tube 102. That is, if the first tube 102 is a round tube, then the cross-sectional shape of the first positive electrode side surface 122 is a circle. Thus, the gap between the first positive electrode side surface 122 and the first tube 102 is uniformly spaced, such that the first positive electrode 104 works uniformly on the plasma gas, and plasma stability is further increased.

Figure 5:
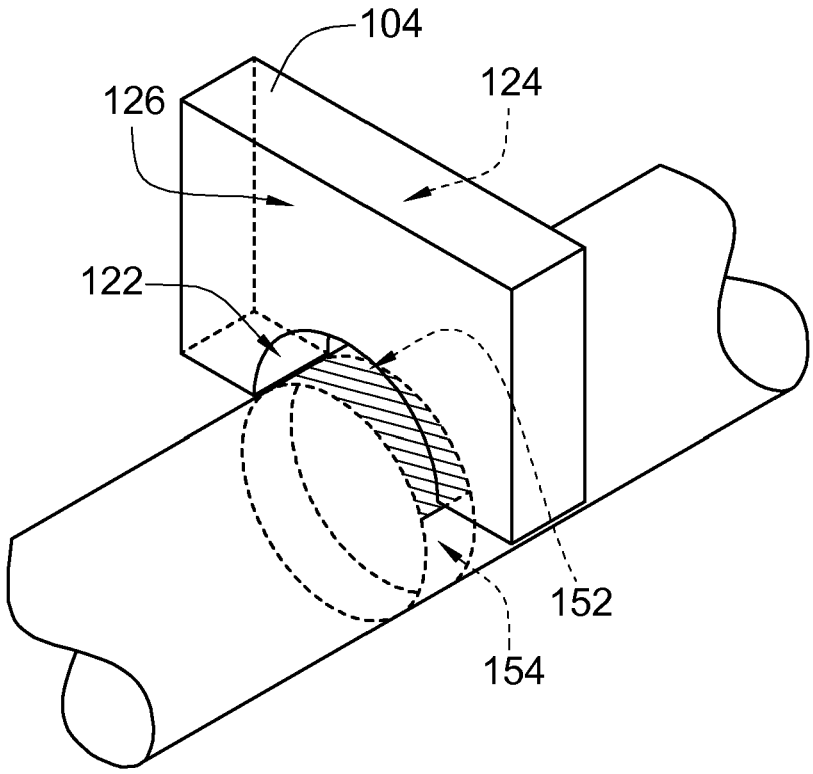
FIG. 5 shows the first positive electrode and the first tube of FIG. 2.

Referring to FIG. 5, the first positive electrode and the first tube of FIG. 2 are shown. The first positive electrode side surface 122 faces a first portion 152 of the first tube 102. The outer circumference of the cross section of the first portion 152 is a first circumference (not illustrated), the outer circumference of the full cross section of the first tube 102 is a second circumference (not illustrated), and the first circumference is at least larger than one half of the second circumference. That is, a first extending portion 154 of FIG. 5 is an extension from the first portion 152, and the area of the first portion 152 is not smaller than the area of the first extending portion 154 to assure that the first positive electrode 104 has sufficient area to work on the plasma gas inside the first tube 102. Despite the number of the first positive electrode 104 is one as exemplified in the present embodiment of the invention, the number of the first positive electrode 104 can be more than one in other embodiments. The number of the first positive electrode 104 is not restricted by the exemplification in the present embodiment of the invention as long as the total area of the first positive electrode side surfaces of the first positive electrodes is enough to allow the plasma gas inside the first tube 102 to generate plasma normally.

Figure 6:
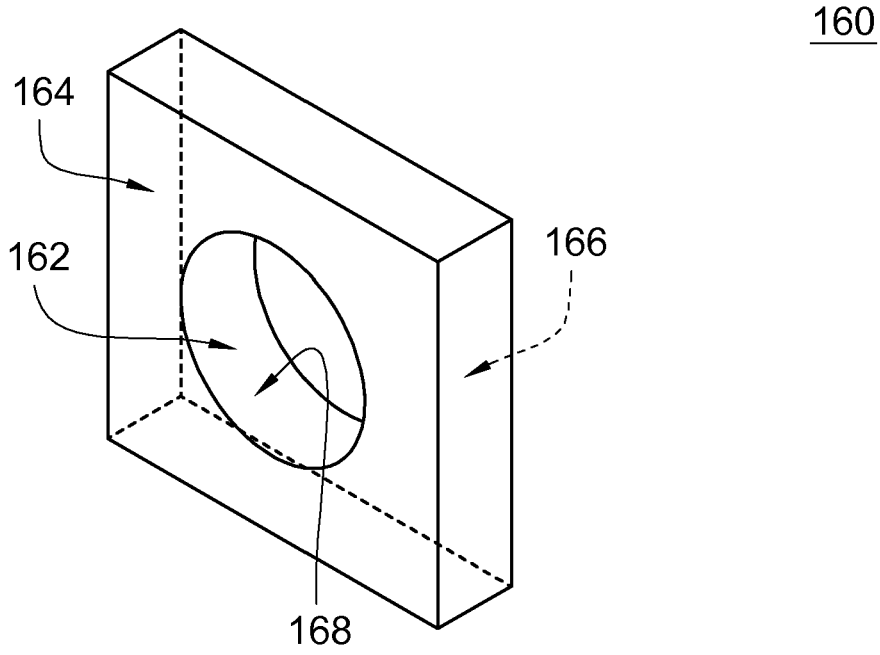
FIG. 6 shows another embodiment of the first positive electrode of FIG. 4.

In the present embodiment of the invention, the shape of the first positive electrode 104 is C-shaped, but the first positive electrode can have other shapes in other embodiments. Referring to FIG. 6, another embodiment of the first positive electrode of FIG. 4 is shown. The first positive electrode 160 further has a positive electrode penetrating portion 162, a first positive electrode side surface 168, a first positive electrode surface 164 and a second positive electrode surface 166. The positive electrode penetrating portion 162 penetrates the first positive electrode surface 164 and the second positive electrode surface 166. The first positive electrode side surface 168 is the inner surface of the positive electrode penetrating portion 162.

Figure 7:
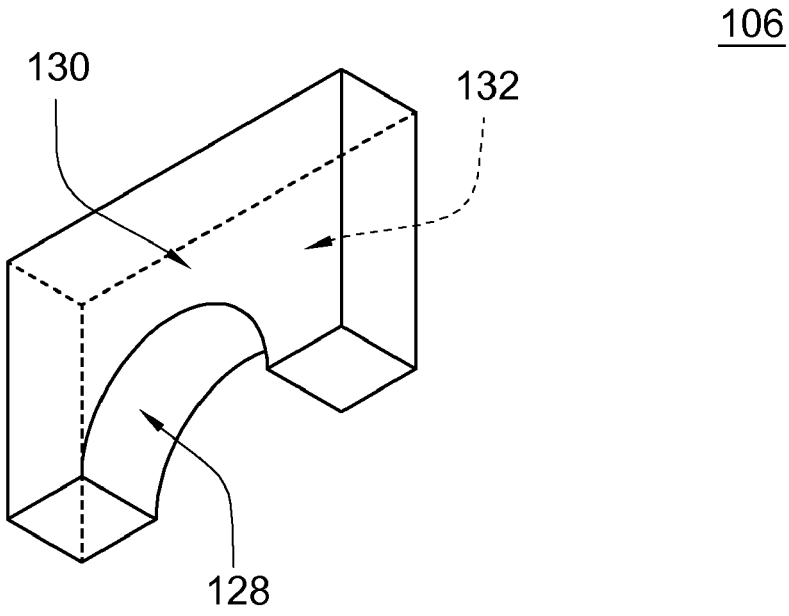
FIG. 7 shows a first negative electrode of FIG. 1.

Referring to FIG. 7, a first negative electrode of FIG. 1 is shown. The first negative electrode 106 has a first negative electrode side surface 128 and a second negative electrode surface 132 opposite to the first negative electrode surface 130. The first negative electrode side surface 128 connected to the first negative electrode surface 130 and the second negative electrode surface 132 is substantially perpendicular to the first negative electrode surface 130. The first negative electrode side surface 128 faces and is adjacent to the first tube 102. As long as the first negative electrode side surface 128 neighbors the first tube 102, the first negative electrode side surface 128 may or may not contact the first tube 102. In the present embodiment of the invention, the first negative electrode side surface 128 does not contact the first tube 102. Besides, the thickness of the first negative electrode is about 5 mm.

Despite the thickness of the first positive electrode 104 and the first negative electrode 106 is exemplified by 5 mm in the present embodiment of the invention, the thickness of the first positive electrode 104 and the first negative electrode 106 is not restricted by the above exemplification as long as the plasma can be uniformly generated.

The cross-sectional shape of the first negative electrode side surface 128 is similar to that of the corresponding first tube 102. That is, if the first tube 102 is a round tube, then the cross-sectional shape of the first negative electrode side surface 128 is a circle. Thus, the distance from the first negative electrode side surface 128 to the first tube 102 is substantially the same, such that the first negative electrode 106 works uniformly on the plasma gas and plasma stability is increased.

Figure 8:
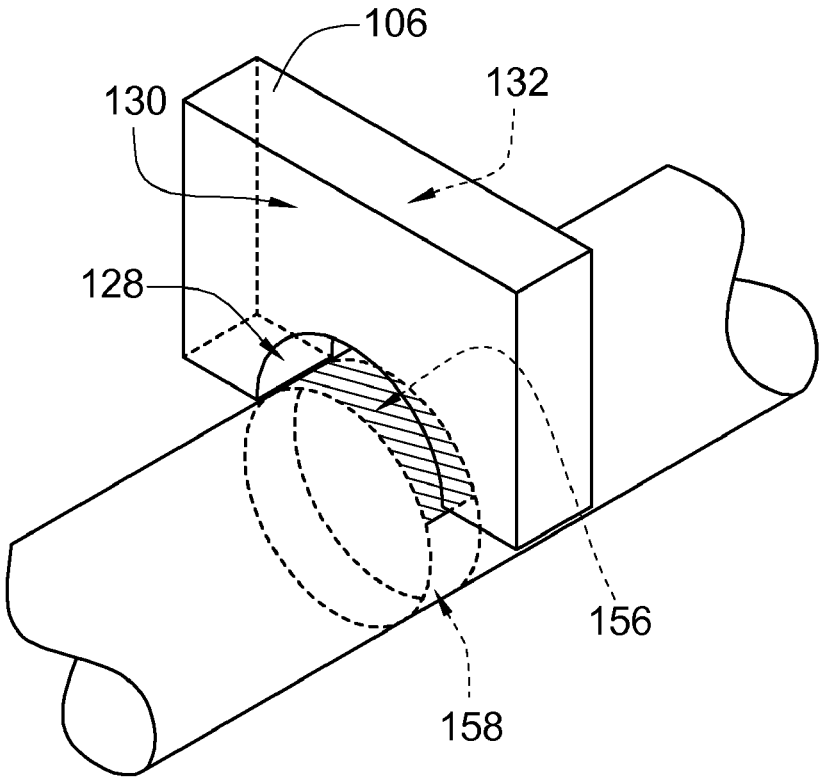
FIG. 8 shows the first negative electrode and the first tube of FIG. 2.

Referring to FIG. 8, the first negative electrode and the first tube of FIG. 2 are shown. The first negative electrode side surface 128 faces a second portion 156 of the first tube 102. The outer circumference of the cross section of the second portion 156 is a third circumference (not illustrated), the outer circumference of the full cross section of the first tube 102 is a fourth circumference (not illustrated), and the third circumference is at least larger than one half of the fourth circumference. That is, a second extending portion 158 of FIG. 8 is an extension from the second portion 156, and the area of the second portion 156 is not smaller than the area of the second extending portion 158 to assure the first negative electrode 106 has sufficient electrode area to work on the plasma gas inside the first tube 102. Furthermore, despite the number of the first negative electrode 106 is one as exemplified in the present embodiment of the invention, the number of the first negative electrode 106 can be more than one in other embodiments. The number of the first negative electrode 106 is not restricted by the exemplification in the present embodiment of the invention as long as the total area of the first negative electrode side surface 128 of the first negative electrode 106 allows the plasma gas inside the first tube 102 to generate plasma normally.

Figure 9:
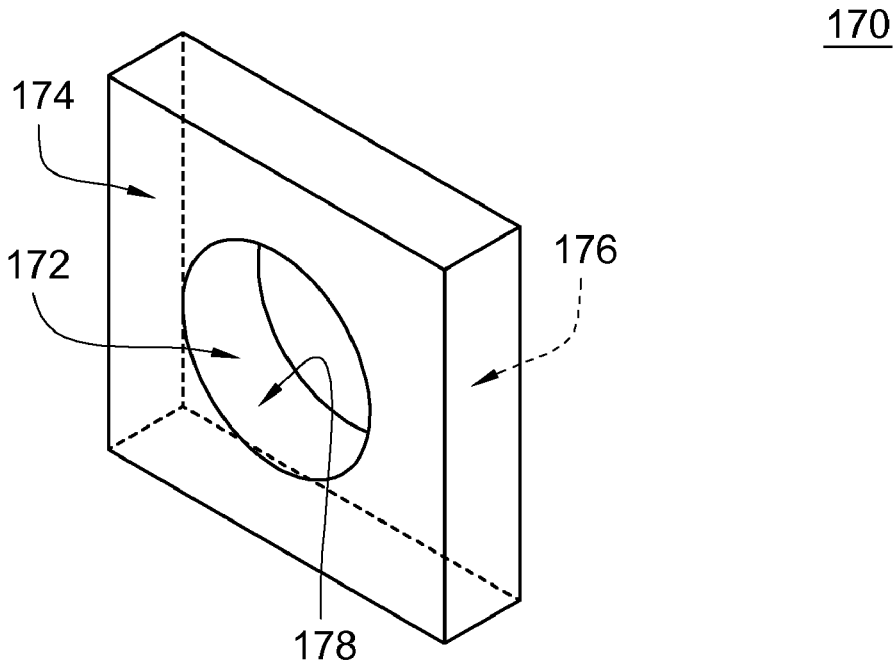
FIG. 9 shows another embodiment of the first negative electrode of FIG. 7.

In the present embodiment of the invention, the shape of the first negative electrode 106 is C-shaped, but the first negative electrode can have other shapes in other embodiments. Referring to FIG. 9, another embodiment of the first negative electrode of FIG. 7 is shown. The first negative electrode 170 has a negative electrode penetrating portion 172, a first negative electrode surface 174, a second negative/positive electrode surface 176 and a first negative electrode side surface 178. The negative electrode penetrating portion 172 penetrates the first negative electrode surface 174 and the second negative/positive electrode surface 176. The first negative electrode side surface 178 is the inner surface of the negative electrode penetrating portion 172.

Preferably, the shape of the first negative electrode is similar to that of the first positive electrode. Thus, the corresponding area between the first negative electrode and the first positive electrode is similar and has a largest overlapped area so as to increase the efficiency and stability for generating plasma.

Figure 10:
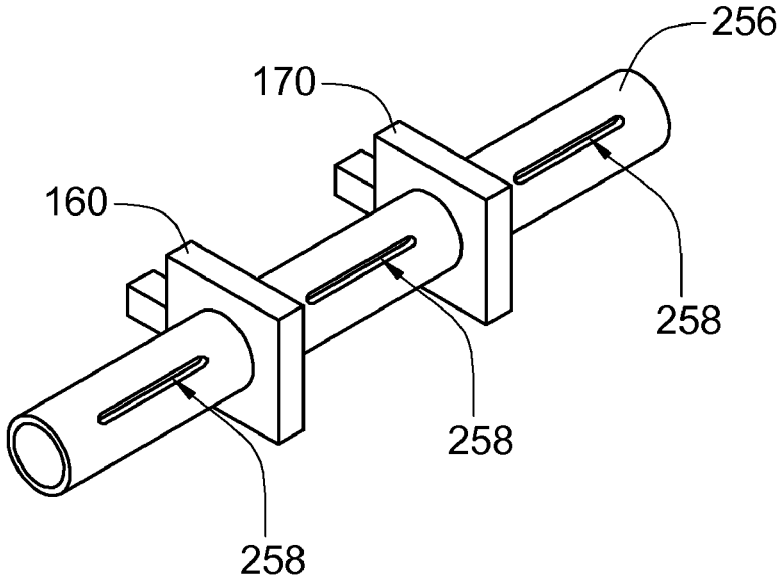
FIG. 10 shows combination of the first positive electrode of FIG. 6, the first negative electrode of FIG. 9 and the first tube of FIG. 2

Referring to FIG. 10, combination of the first positive electrode of FIG. 6, the first negative electrode of FIG. 9 and the first tube of FIG. 2 is shown. A first tube 256 of FIG. 10 has several first plasma jet openings 258, and the shape of the first plasma jet openings 258 is bar-shaped. The first plasma jet openings 258, the first positive electrode 160 and the first negative electrode 170 are interlaced. That is, the first plasma jet openings 258 do not face the first positive electrode 160 or the first negative electrode 170. Thus, by increasing the size of the first plasma jet opening, the emission coverage of the plasma inside the first tube 256 is increased, and the range of plasma treatment is expanded.

Figure 11:
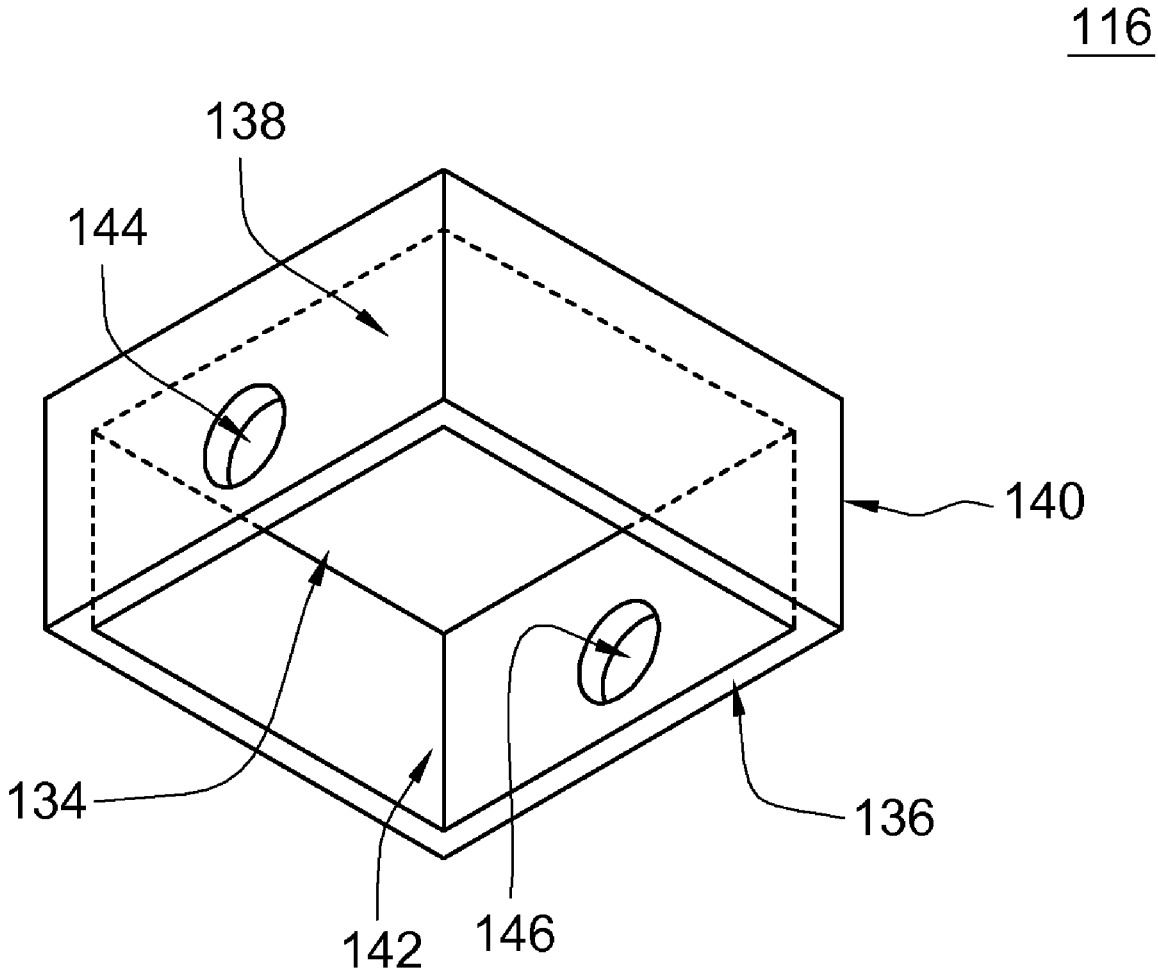
FIG. 11 shows the casing of FIG. 1.

Referring to FIG. 11, a casing of FIG. 1 is shown. The casing 116 has a recess 134, a casing bottom surface 136 and a first casing side surface 138 and a second casing side surface 140 opposite to the first casing side surface 138. The casing bottom surface 138 is connected to the first casing side surface 138 and the second casing side surface 140. The recess 134 has a recess opening 142 exposed on the casing bottom surface 136. The first casing side surface 138 has a first accommodation hole 144. The second casing side surface 140 has a second accommodation hole 146. The first tube 102 (illustrated in FIG. 1) is disposed in the first accommodation hole 144 and the second accommodation hole 146. The recess opening 134 is exposed to the first tube 102, the first positive electrode 104 and the first negative electrode 106. The first plasma jet openings 110 face recess opening 142. The first positive electrode 104, the first negative electrode 106 and the first plasma jet opening 110 are all illustrated in FIG. 1.

Second Embodiment

Figure 12:
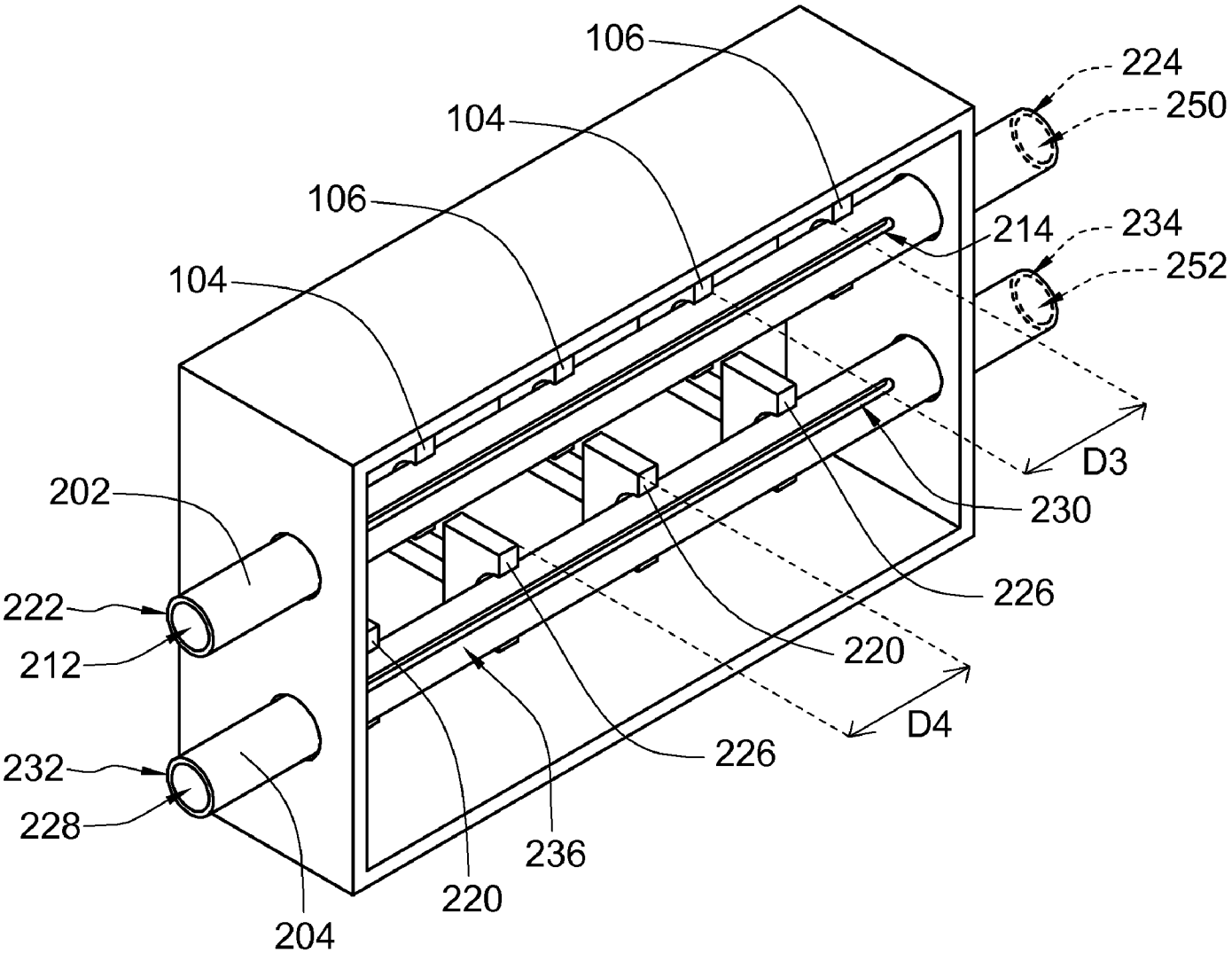
FIG. 12 shows a plasma system according to second embodiment of the invention.

Referring to FIG. 12, a plasma system according to second embodiment of the invention is shown. The second embodiment differs with the first embodiment in that the second embodiment has several sets of tubes and several sets of positive and negative electrodes, and the casing further has a cooling channel. As indicated in FIG. 12, the plasma system 200 includes a first tube 202, a second tube 204 and a casing 206. The first tube 202 has several first positive electrodes 104 and several first negative electrodes 106, and further has a first end surface 222, a second end surface 224, a first inlet 212, a third inlet 250 and a first plasma jet opening 214. The first inlet 212 is disposed on the first end surface 222, and the third inlet 250 is disposed on the second end surface 224. The shape of the first plasma jet opening 214 is bar-shaped, the length of which is larger than a first predetermined distance D3 between the first positive electrode 104 and the first negative electrode 106. Preferably, the length of the first plasma jet opening 214 is approximately equal to the length of the distribution of the electrodes. That is, the first plasma jet opening 214 passes through all of the first positive electrode s104 and the first negative electrodes 106.

As indicated in FIG. 12, the second tube 204 and the first tube 202 are neighbored and arranged in parallel. The second tube 204 includes several second positive electrodes 220, several second negative electrodes 226, and has a second inlet 228, a fourth inlet 252, a second plasma jet opening 230, a third end surface 232 and a fourth end surface 234. A plasma gas passes through the second inlet 228 and enters the second tube 204. The second positive electrodes 220 and the second negative electrodes 226 are disposed between the third end surface 232 and the fourth end surface 234. The second plasma jet opening 230 disposed between the second positive electrodes 220 and the second negative electrodes 226 penetrates through the wall 236 of the second tube 204. The plasma passes through the plasma jet opening and is emitted to the outside of the second tube 204. The shape of the second plasma jet opening 230 is bar-shaped, the length of which is larger than a second predetermined distance D4 between the second positive electrodes 220 and the second negative electrodes 226. Preferably, the length of the second plasma jet opening 230 is approximately equal to the length of the distribution of the electrodes. That is, the second plasma jet opening 230 passes through all of the second positive electrodes 220 and the second negative electrodes 226.

As indicated in FIG. 12, the first positive electrode 104, the second positive electrodes 220, the first negative electrode 106 and the second negative electrodes 226 are interlaced. As the interlaced positive and negative electrodes are more uniformly distributed, the emission of the plasma is more uniformly distributed as well. Furthermore, with the arrangement of several sets of tubes and electrodes, the range of plasma treatment is expanded without using an expensive and high-precision carrying platform. Thus, surface treatment such as hydrophilic treatment, hydrophobic treatment or surface cleaning can be performed to a work piece whose area is large.

Figure 13:
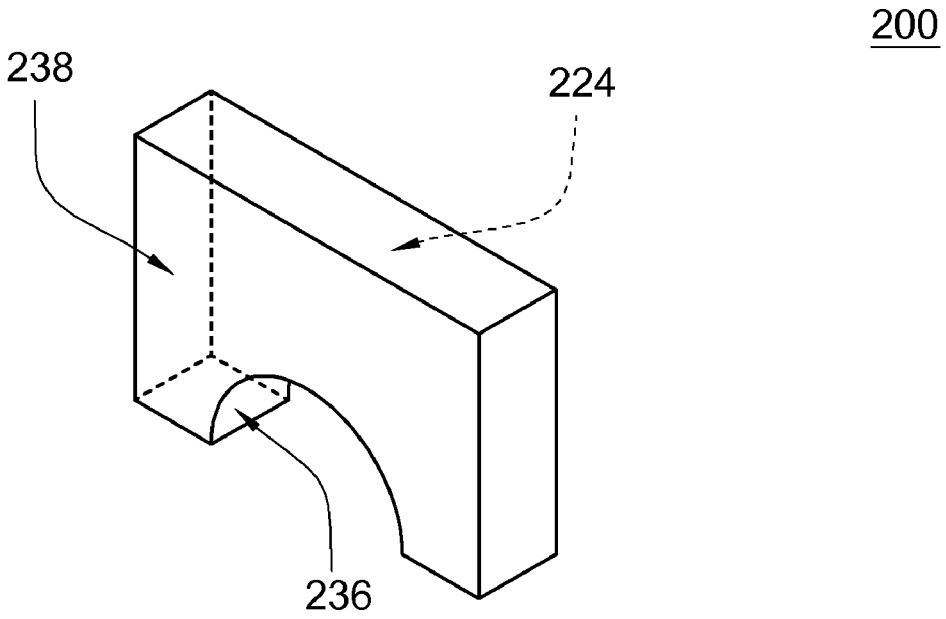
FIG. 13 shows a second positive electrode of FIG. 12.

Referring to FIG. 13, a second positive electrode of FIG. 12 is shown. The second positive electrodes 220 has a second positive electrode side surface 236, a third positive electrode surface 238 and a fourth positive electrode surface 240 opposite to the third positive electrode surface 238. The second positive electrode side surface 236 is substantially perpendicular to the third positive electrode surface 238. The second positive electrode side surface 236 is connected to the third positive electrode surface 238 and the fourth positive electrode surface 240. The second positive electrode side surface 236 faces and is adjacent to the second tube 204 (the second tube 204 is illustrated in FIG. 12).

Figure 14:
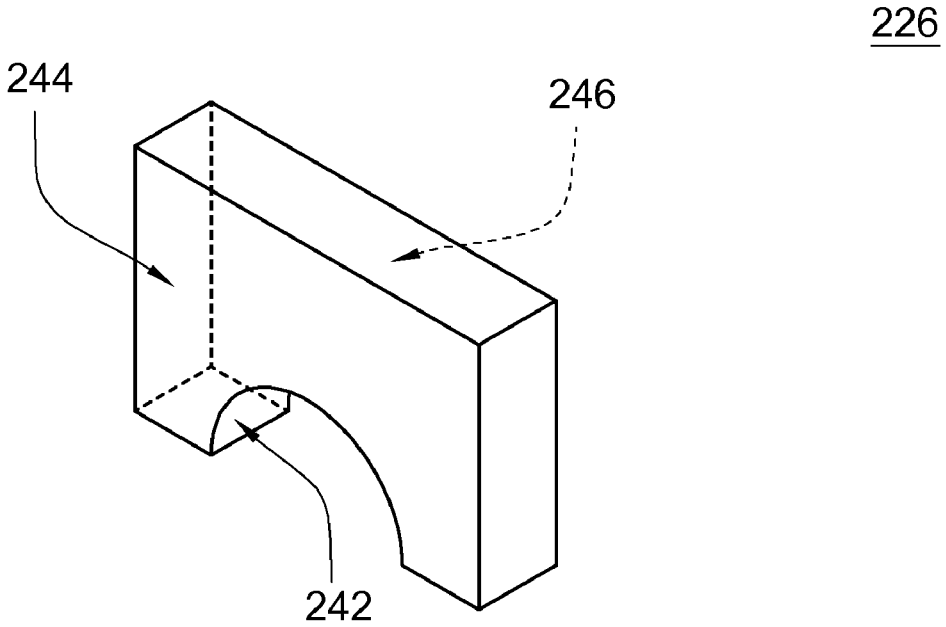
FIG. 14 shows a second negative electrode of FIG. 12.

Referring to FIG. 14, a second negative electrode of FIG. 12 is shown. The second negative electrodes 226 has a second negative electrode side surface 242, a third negative electrode surface 244 and a fourth negative electrode surface 246 opposite to the third negative electrode surface 244. The second negative electrode side surface 242 is substantially perpendicular to the third negative electrode surface 244. The second negative electrode side surface 242 is connected to the third negative electrode surface 244 and the fourth negative electrode surface 246. The second negative electrode side surface 242 faces and is adjacent to the second tube 204.

Figure 15:
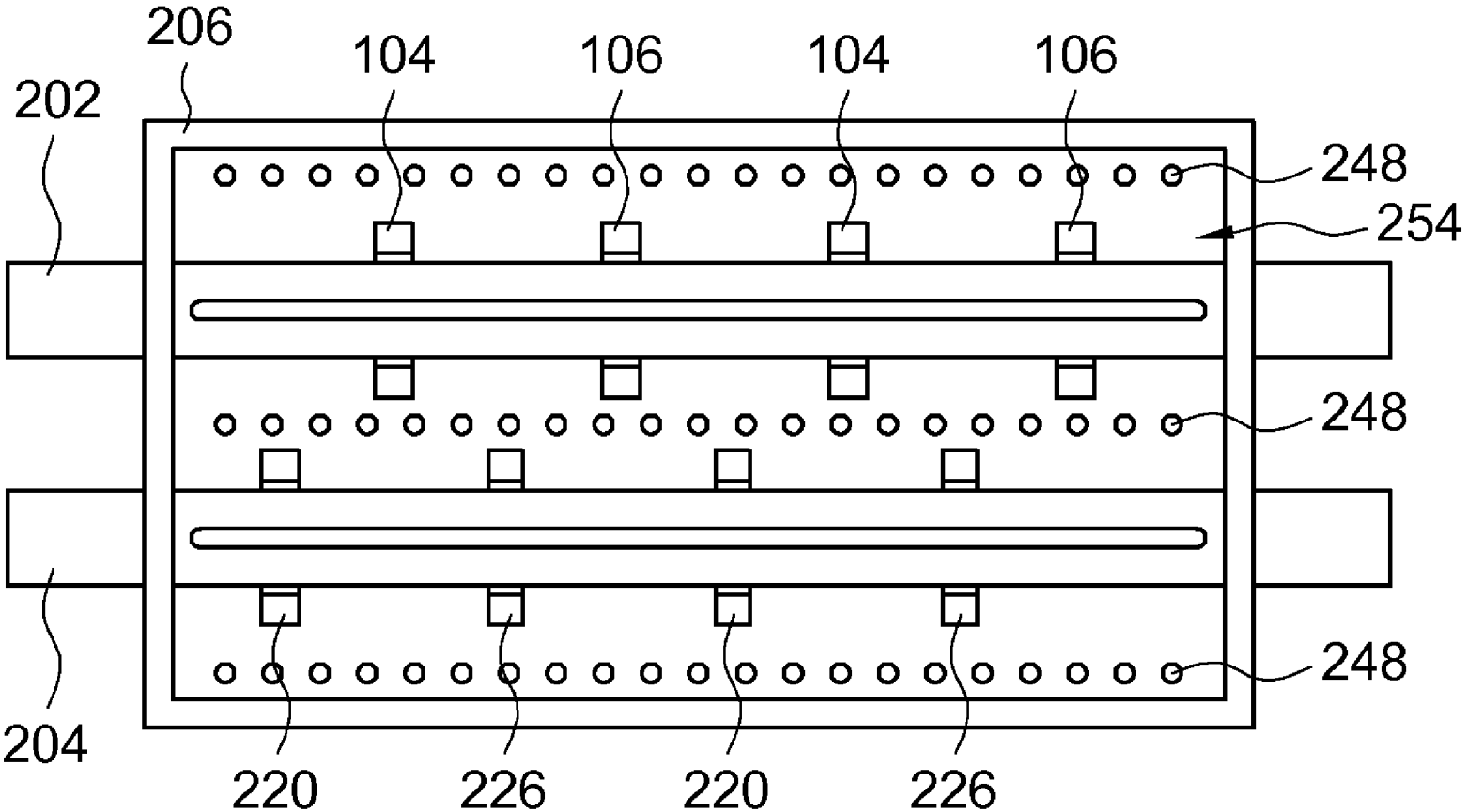
FIG. 15 shows a casing having a cooling channel according to FIG. 12.

Referring to FIG. 15, a casing having a cooling channel according to FIG. 12 is shown. The casing 206 further has a cooling channel 248 interconnected with a recess 254 of the casing 206 for a cooling gas (not illustrated) to pass through, such that the first positive electrode 104, the first negative electrode 106, the second positive electrodes 220 and the second negative electrodes 226 inside the recess 254 are cooled. Preferably, a channel opening (not illustrated) of the cooling channel 248 faces towards the first positive electrode 104, the first negative electrode 106, the second positive electrodes 220 and the second negative electrodes 226, so that the cooling gas is emitted to the electrodes directly to achieve better cooling effect.

Despite the number of the tubes is two in the second embodiment, the number of the tubes can be more than two in other embodiments and is not restricted by the exemplification in the present embodiment of the invention. In the present embodiment of the invention, each tube has two sets of positive/negative electrodes, but each tube can have more than two sets of positive/negative electrode in other embodiments and the number of sets is not restricted by the exemplification in the present embodiment of the invention. Furthermore, the tubes can have different number of sets of positive/negative electrodes. For example, the first tube has two sets of positive and negative electrodes, and the second tube has one set, three sets or four sets of positive and negative electrodes.

The plasma system disclosed in the above embodiments is used in a constant-pressure environment. Thus, the plasma systems 100 and 200 can further be used in a roll-to-roll process to increase production rate without using expensive vacuum facility.

The plasma system disclosed in the above embodiments of the invention has many advantages exemplified below:

(1) The first positive electrode, the first negative electrode, the second positive electrode and the second negative electrode and the reaction chamber (that is, inside the first tube and the second tube) are separated, so that the plasma particles do not contact the electrode, and the plasma do not contact the electrodes during the process of being emitted to the outside of the first tube and the second tube. Thus, the electrodes will not be polluted or damaged.

(2) The arrangement of multi-tubes and multi-sets of electrodes increases the emission coverage of plasma, so that surface treatment can be applied to a work-piece whose area is large, not only increasing treatment efficiency but also expanding the range of application of the plasma system.

(3) The first positive electrode, the second positive electrode, the first negative electrode and the second negative electrode are interlaced, so that the electrodes are distributed uniformly and the uniformity in plasma emission is improved.

(4) The plasma system not only is applicable to constant-pressure environment without using expensive vacuum facility but also can be used in a roll-to-roll process to increase production rate.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A plasma system for generating a plasma, the plasma system comprising:

a first tube having a first inlet, at least one first plasma jet opening, a first end surface and a second end surface, wherein the first inlet is disposed on one of the first end surface and the second end surface, wherein a plasma gas passes through the first inlet and enters the first tube, the at least one first plasma jet opening penetrates the wall of the first tube, and the plasma passes through the at least one first plasma jet opening and is emitted to the outside of the first tube;

a first positive electrode having a first positive electrode side surface and a first positive electrode surface, wherein the first positive electrode side surface is connected to the first positive electrode surface, and the first positive electrode side surface only surrounds a first portion of the first tube; and a first negative electrode having a first negative electrode side surface and a first negative electrode surface, wherein the first negative electrode side surface is connected to the first negative electrode surface, the first negative electrode side surface only surrounds a second portion of the first tube, and the first negative electrode surface is separated from the first positive electrode surface by a first predetermined distance;

wherein the first positive electrode and the first negative electrode are disposed between the first end surface and the second end surface, at least a portion of the first plasma jet opening is disposed between the first positive and first negative electrode, and the at least one first plasma jet opening is located on a side of the tube opposite to the first and second portions of the tube.

2. The plasma system according to claim 1, wherein the first positive electrode side surface is substantially perpendicular to the first positive electrode surface, and the first negative electrode side surface is substantially perpendicular to the first negative electrode surface.

3. The plasma system according to claim 1, wherein the first positive electrode side surface and the first negative electrode side surface contact the first tube.

4. The plasma system according to claim 1, wherein the outer circumference of the cross section of the first portion is a first circumference, the outer circumference of the full cross section of the first tube is a second circumference, and the first circumference is at least larger than one half of the second circumference.

5. The plasma system according to claim 1, wherein the outer circumference of the cross section of the second portion is a third circumference, the outer circumference of the full cross section of the first tube is a fourth circumference, and the third circumference is at least larger than one half of the fourth circumference.

6. The plasma system according to claim 1, wherein the shape of the at least one first plasma jet opening is a circle.

7. The plasma system according to claim 1, wherein the shape of the at least one first plasma jet opening is bar-shaped.

8. The plasma system according to claim 1, wherein the cross-sectional shape of the first positive electrode side surface is similar to that of the corresponding first tube.

9. The plasma system according to claim 1, wherein the cross-sectional shape of the first negative electrode side surface is similar to that of the corresponding first tube.

10. The plasma system according to claim 1, wherein the first positive electrode further has a positive electrode penetrating portion and a second positive electrode surface opposite to the first positive electrode surface, the first positive electrode side surface connects the second positive electrode surface, the positive electrode penetrating portion penetrates the first positive electrode surface and the second positive electrode surface, and the first positive electrode side surface is the inner surface of the positive electrode penetrating portion.

11. The plasma system according to claim 1, wherein the first negative electrode further has a negative electrode penetrating portion and a second negative electrode surface opposite to the first negative electrode surface, the first negative electrode side surface connects the second negative electrode surface, the negative electrode penetrating portion penetrates the first negative electrode surface and the second negative electrode surface, and the first negative electrode side surface is the inner surface of the negative electrode penetrating portion.

12. The plasma system according to claim 1, wherein the first tube further has a second inlet disposed on the other one of the first end surface and the second end surface, and the plasma gas passes through the second inlet and enters the first tube.

13. The plasma system according to claim 1, wherein the other one of the first end surface and the second end surface is a closed end surface.

14. The plasma system according to claim 1, further comprising:

a casing having a recess, an casing bottom surface, a first casing side surface and a second casing side surface opposite to the first casing side surface, the casing bottom surface is connected to the first casing side surface and the second casing side surface, the recess has a recess opening exposed to the casing bottom surface, the first casing side surface has a first accommodation hole, the second casing side surface has a second accommodation hole, the first tube is disposed in the first accommodation hole and the second accommodation hole, the first tube, the first positive electrode and the first negative electrode are exposed to the recess opening, and the first plasma jet opening faces the recess opening.

15. The plasma system according to claim 14, wherein the casing further has a cooling channel interconnected with the recess.

16. The plasma system according to claim 1, wherein the first predetermined distance is at least larger than 6 millimeter (mm).

17. The plasma system according to claim 1, further comprising:

a second tube neighbored and arranged in parallel with the first tube, wherein the second tube has a second inlet, at least one second plasma jet opening, a third end surface and a fourth end surface, the second inlet is disposed on one of the third end surface and the fourth end surface, the plasma gas passes through the second inlet and enters the second tube, the at least one second plasma jet opening penetrates the wall of the second tube, and the plasma passes through the at least one second plasma jet opening and is emitted to the outside of the second tube;

a second positive electrode having a second positive electrode side surface and a third positive electrode surface, wherein the second positive electrode side surface is connected to the third positive electrode surface, and the second positive electrode side surface faces and only surrounds a first portion of the second tube; and a second negative electrode having a second negative electrode side surface and a third negative electrode surface, wherein the second negative electrode side surface is connected to the third negative electrode surface, the second negative electrode side surface faces only surrounds a first portion of the second tube, and the third negative electrode surface is separated from the third positive electrode surface by a second predetermined distance;

wherein the second positive electrode and the second negative electrode are disposed between the third end surface and the fourth end surface, at least a portion of the second plasma jet opening is disposed between the second positive electrode and the second negative electrode, the at least one second plasma jet opening is located on a side of the tube opposite to the first and second portions of the tube, and the first positive electrode, the second positive electrode, the first negative electrode and the second negative electrode are staggered.

18. The plasma system according to claim 17, wherein the second positive electrode side surface is substantially perpendicular to the third positive electrode surface, and the second negative electrode side surface is substantially perpendicular to the third negative electrode surface.

19. The plasma system according to claim 17, wherein the shape of the second plasma jet opening is a circle.

20. The plasma system according to claim 17, wherein the shape of the second plasma jet opening is a bar-shaped.

21. The plasma system according to claim 17, wherein the second predetermined distance is at least larger than 6 millimeter.

22. The plasma system according to claim 17, wherein the first tube and the second tube are made from a dielectric material.

* * * * *